US010495403B1

(12) United States Patent
Liu

(10) Patent No.: US 10,495,403 B1
(45) Date of Patent: Dec. 3, 2019

(54) ARROW SUPPLY ASSEMBLY FOR BOW

(71) Applicant: Chi-Chang Liu, Taichung (TW)

(72) Inventor: Chi-Chang Liu, Taichung (TW)

(73) Assignee: POE LANG ENTERPRISE CO., LTD., Taichung ( * ) Notice: Subject to any disclaimer, the term of this patent is extended or adjusted under 35 U.S.C. 154(b) by 0 days.

(21) Appl. No.: 16/357,219

(22) Filed: Mar. 18, 2019

(51) Int. Cl.
*F41B 5/06* (2006.01)
*F41B 5/14* (2006.01)

(52) U.S. Cl.
CPC ..... *F41B 5/066* (2013.01); *F41B 5/143* (2013.01)

(58) Field of Classification Search
CPC .. F41B 5/066; F41B 5/126; F41B 5/14; F41B 5/143
See application file for complete search history.

(56) References Cited

U.S. PATENT DOCUMENTS 918,444 A * 4/1909 Griffith
3,739,765 A * 6/1973 Moore ..... F41B 5/12 124/25
3,968,783 A * 7/1976 Pfotenhauer ..... F41B 5/126 124/25
5,544,641 A * 8/1996 Jenn ..... F41B 5/12 124/25
6,868,845 B1 * 3/2005 Moore ..... F41B 5/126 124/25
7,461,647 B1 * 12/2008 Slinkard ..... F41B 5/066 124/25.7
9,261,322 B1 * 2/2016 Conkel ..... F41B 5/126

* cited by examiner

*Primary Examiner* — John A Ricci

(57) ABSTRACT

An arrow supply assembly for a bow includes an operation box connected to riser of a bow, and a cartridge is connected to the operation box. The operation box includes a first passage defined axially through two sides thereof, and a string of the bow movably extends through the first passage. The cartridge includes a second passage communicating with the first passage. The second passage includes an insertion path and an entrance. The insertion path accepts multiple arrows to be stored in the cartridge. A press member is pivotably connected to the cartridge and biased by a resilient member so as to press and supply the arrows in the cartridge into the first passage. The users pull the string continuously to shoot the arrows that are fed into the first passage of the operation box.

10 Claims, 11 Drawing Sheets

ARROW SUPPLY ASSEMBLY FOR BOW

BACKGROUND OF THE INVENTION

1. Fields of the Invention

The present invention relates to an arrow supply assembly for a bow, and more particularly, to an operation box for operation of the string, and an arrow cartridge with multiple arrows stored therein.

2. Descriptions of Related Art

The conventional way to use a bow is to set tail end of an arrow to the string, and the string is pulled to generate energy by the deformation of the string, and when the user releases the string, the stored energy delivers the arrow out. It is noted that after the first arrow is delivered, the user has to change his/her pose so as to pick the second arrow to be set to the string, and repeats the above mentioned steps again to shoot the second arrow. Specifically, the user has to aim every time when an arrow is set to the string and the string is pulled. The efficiency is obviously low and the processes take a lot of time.

The present invention intends to provide an arrow supply assembly for a bow, and the arrow supply assembly stores multiple arrows which are automatically supplied to the position ready to be aimed and shot.

SUMMARY OF THE INVENTION

The present invention relates to an arrow supply assembly for a bow, and comprises an operation box having the first end connected to a riser of a bow, and a connection portion is formed to the second end of the operation box. The operation box includes a first passage defined axially through two sides thereof, and a string of the bow movably extends through the first passage. A cartridge is connected to the connection portion and includes a second passage which communicates with the first passage. The second passage includes an insertion path and an entrance, wherein the insertion path accepts multiple arrows to be stored in the cartridge. A press member has a first end pivotably connected to the cartridge, and a resilient member is connected between the press member 3 and the cartridge 2 so as to bias the first end of the press member. The second end of the press member is inserted into the insertion path and presses and supply the arrows in the cartridge into the first passage via the entrance.

The primary object of the present invention is to provide an arrow supply assembly for a bow, and arrows stored in the cartridge are fed into the first passage of the operation box continuously. The users simply pull the string to continuously shoot the arrows.

The present invention will become more apparent from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
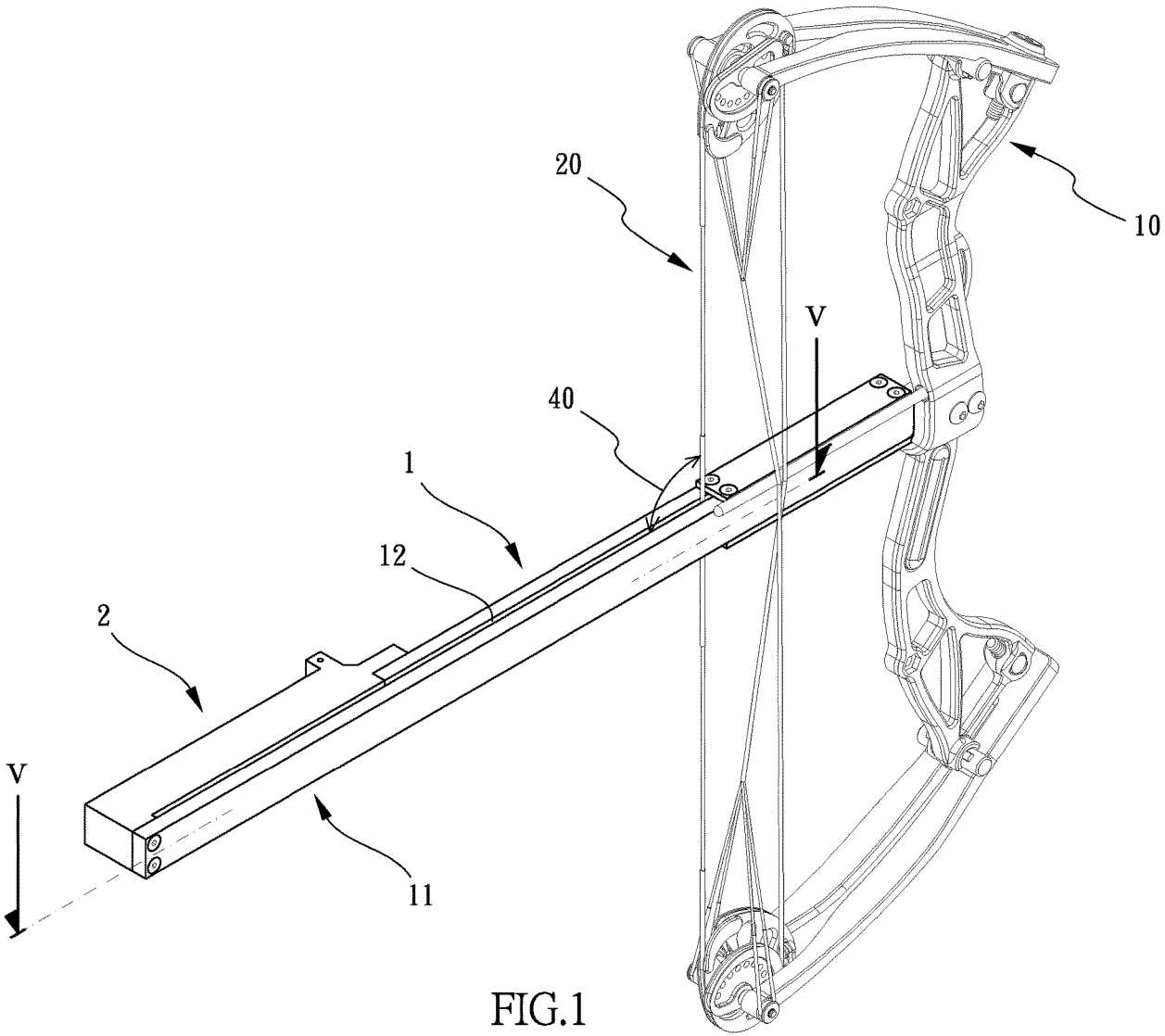
FIG. 1 is a perspective view to show the bow with the arrow supply assembly of the present invention.
Figure 2:
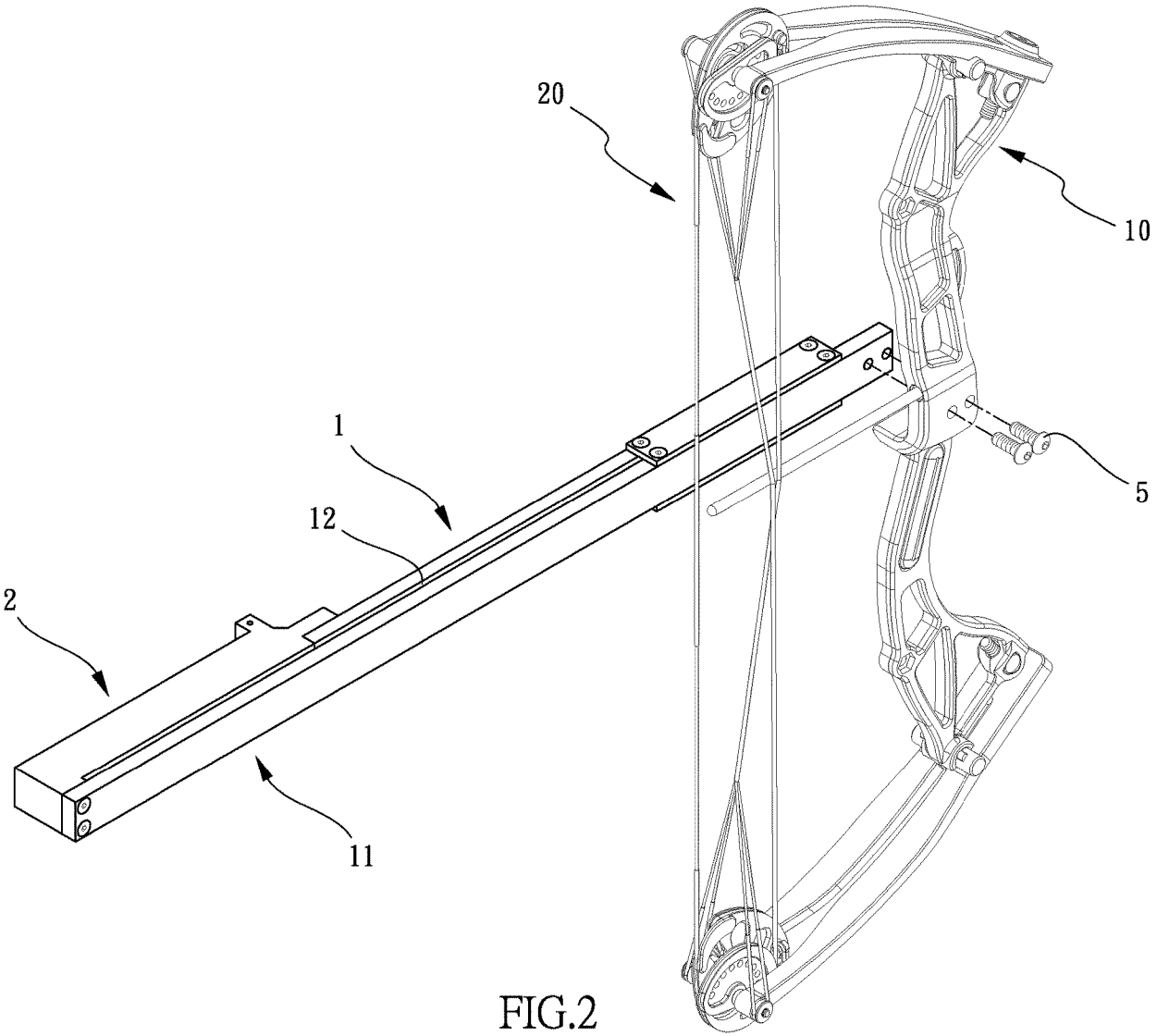
FIG. 2 is a perspective view to show the bow and the arrow supply assembly of the present invention.
Figure 3:
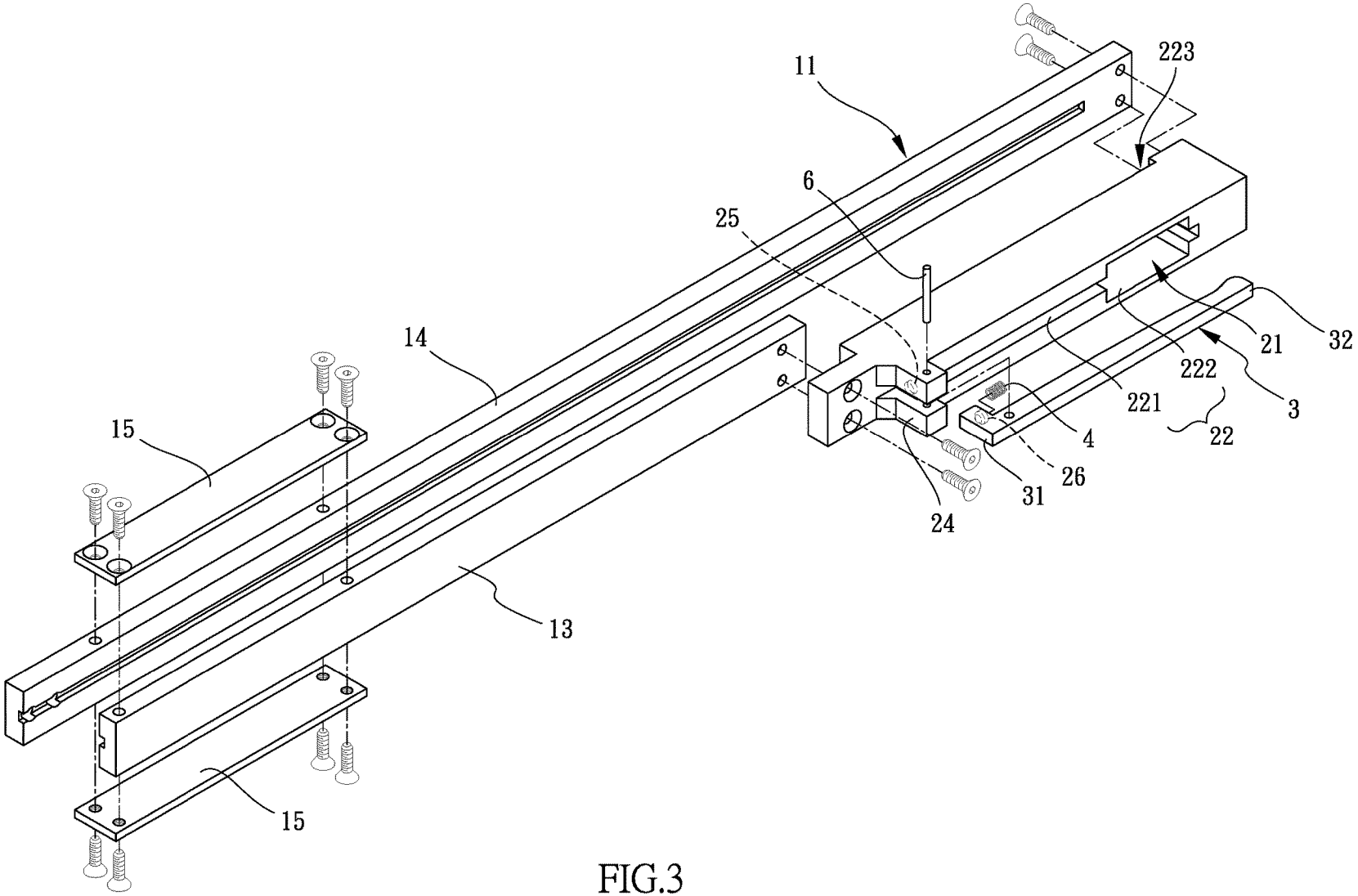
FIG. 3 is an exploded view of the arrow supply assembly of the present invention.

Referring to FIGS. 1 to 9, the arrow supply assembly for a bow of the present invention comprises an operation box 1 and a cartridge 2. The operation box 1 has a first end connected to the riser 10 of a bow, and a connection portion 11 is formed to the second end of the operation box 1. A first passage 12 is defined axially through two sides thereof. A string 20 of the bow connected to two limbs of the bow movably extends through the first passage 12. An angle 40 less than 180 degrees is formed between the string 20 and an outside of the operation box 1. The cartridge 2 is connected to the connection portion 11 and includes a second passage 21 which communicates with the first passage 12. The second passage 21 includes an insertion path 22 and an entrance 23, wherein the insertion path 22 accept multiple arrows 30 to be stored in the cartridge 2. Specifically, as shown in FIG. 3, the operation box 1 includes a first plate 13, a second plate 14 and two third plates 15. The two third plates 15 are connected between the first and second plates 13, 14. The first plate 13 is shorter than the second plate 14, wherein the second plate 14 has the first end thereof connected to the riser 10 by bolts 5 as shown in FIG. 2, and the first end of the first plate 13 is located at a distance from the first end of the second plate 14. The first passage 12 is defined between the first plate 13, the second plate 14 and the two third plates 15. The operation box 1 allows the users to assembly without difficulties. It is noted that the operation box 1 is located 5 inches above or below the center point of the string 20.

As shown In FIG. 3, the cartridge 2 includes a first end and a second end, wherein two lugs 24 extend from the first end of the cartridge 2 and the first end of the cartridge 2 is located close to the riser 10 than the second end of the cartridge 2.

An L-shaped press member 3 includes the first end thereof pivotably connected to the cartridge 2, and a resilient member 4 is connected between the press member 3 and the cartridge 2 so as to bias the first end of the press member 3. The second end of the press member 3 is inserted into the insertion path 22 and presses and supplies the arrows 30 in the cartridge 2 into the first passage 12 via the entrance 23. Specifically, the first end of the press member 3 is pivotably connected between the two lugs 24 by extending a pin 6. The cartridge 2 includes a first recess 25 that is located corresponding to the first end of the resilient member 4, and the press member 3 includes a second recess 26 that is located corresponding to the second end of the resilient member 4. The first and second ends of the resilient member 4 are secured in the first and second recesses 25, 26. Specifically, the press member 3 includes a pivotal portion 31 and an arm 32 which extends perpendicular to the pivotal portion 31. The second recess 26 is defined in the pivotal portion 31 which is pivotably connected between the two lugs 24. The arm 32 is inserted into the insertion path 22 and includes at least one point to press the arrows 30. The distal end of the arm 32 is a rounded end which does not damage the arrows 30. In the first embodiment, the resilient member 4 extends the same direction as the arm 32, the resilient member 4 is connected between the pivotal portion 31 and the cartridge 2.

Figure 4:
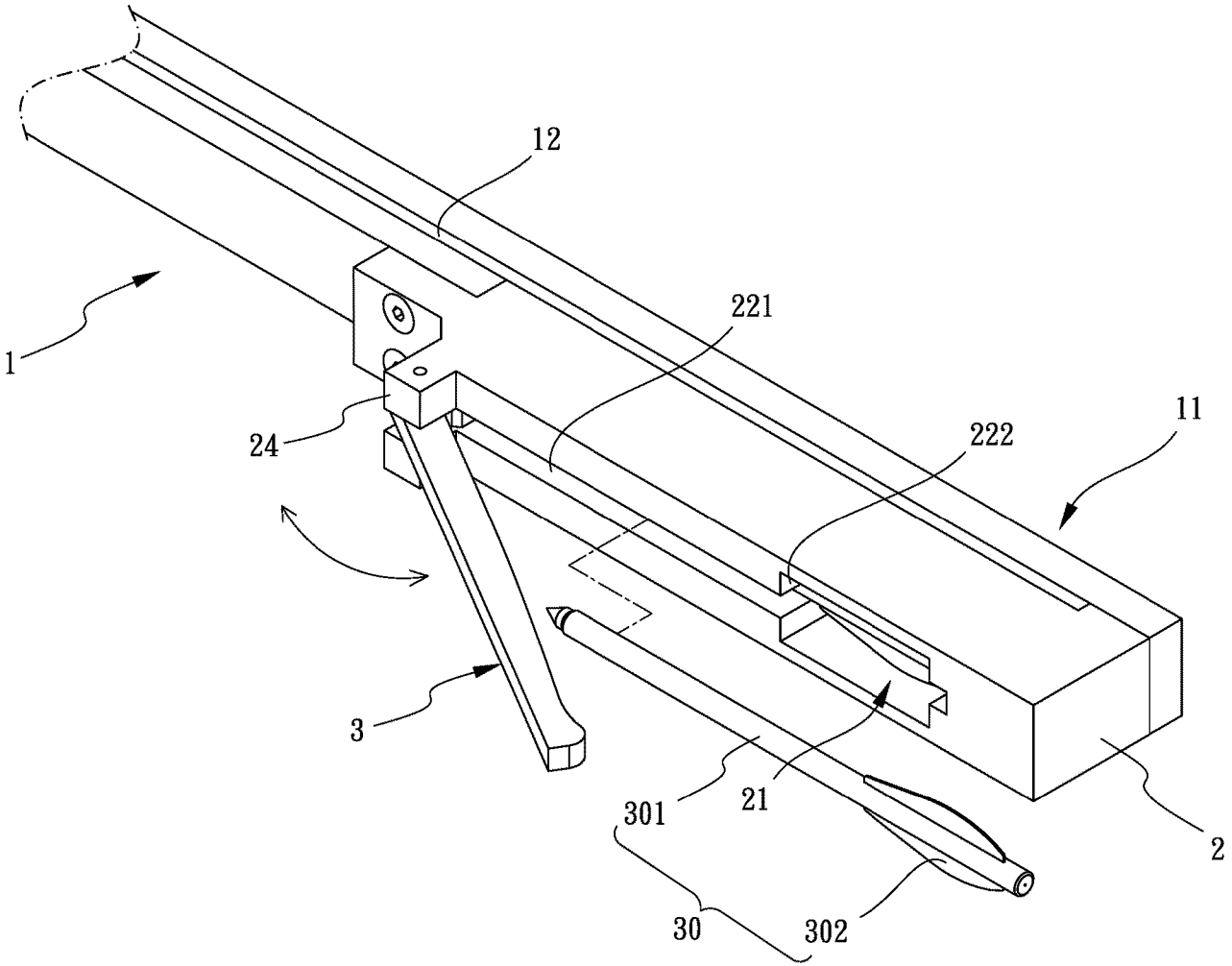
FIG. 4 shows that an arrow is to be inserted into the cartridge of the arrow supply assembly of the present invention.
Figure 5:
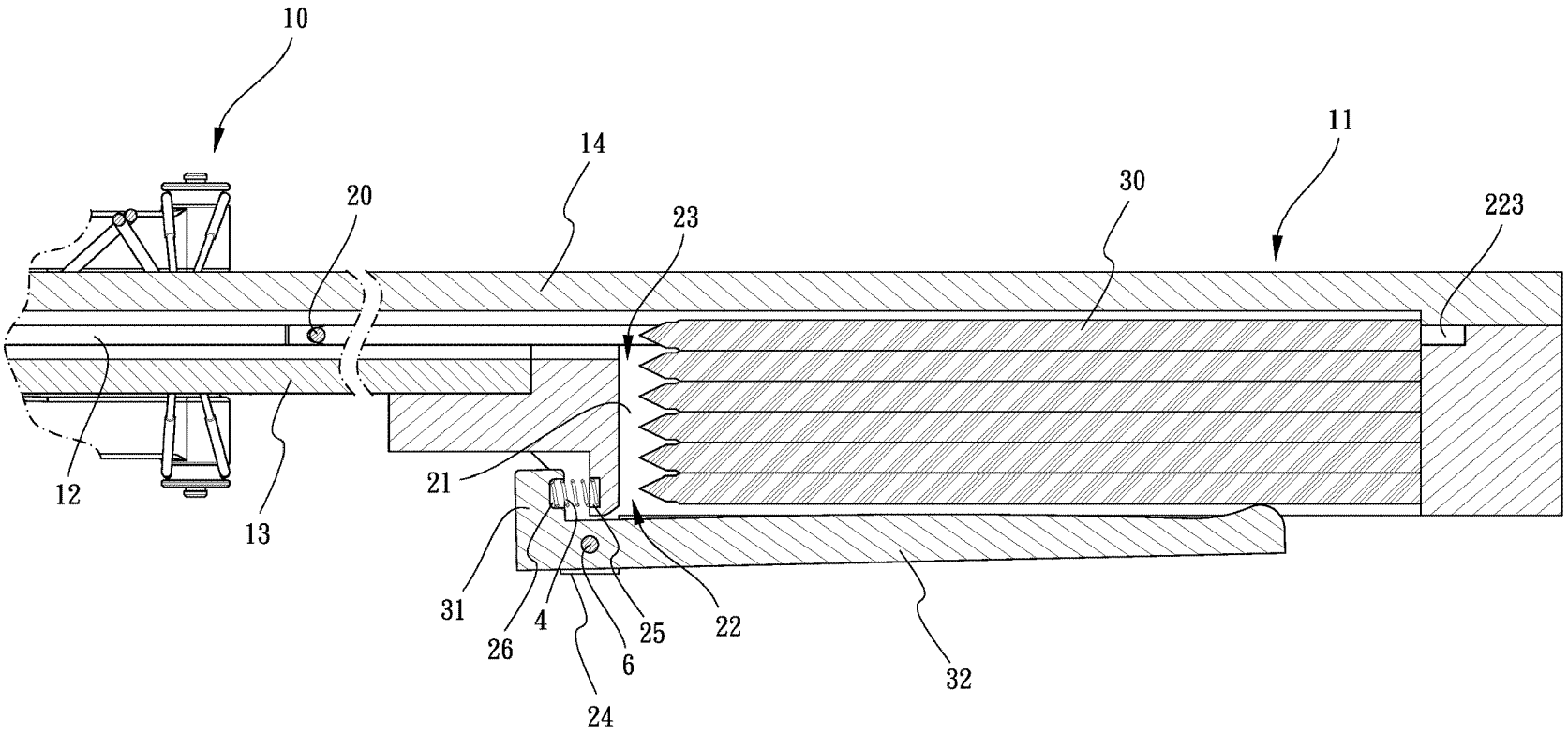
FIG. 5 is a cross sectional view, taken along line V-V of FIG. 1.
Figure 6:
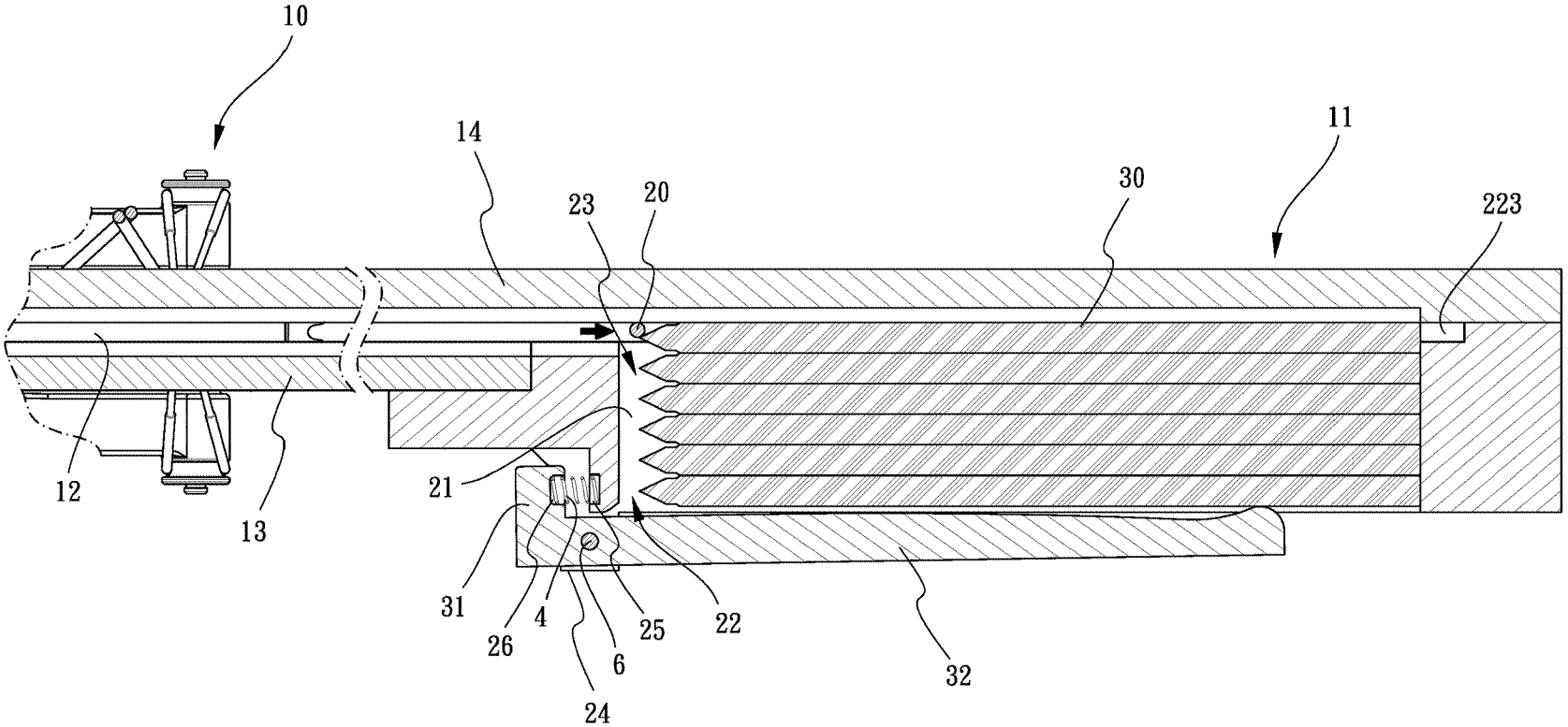
FIG. 6 shows that the string is pulled.
Figure 7:
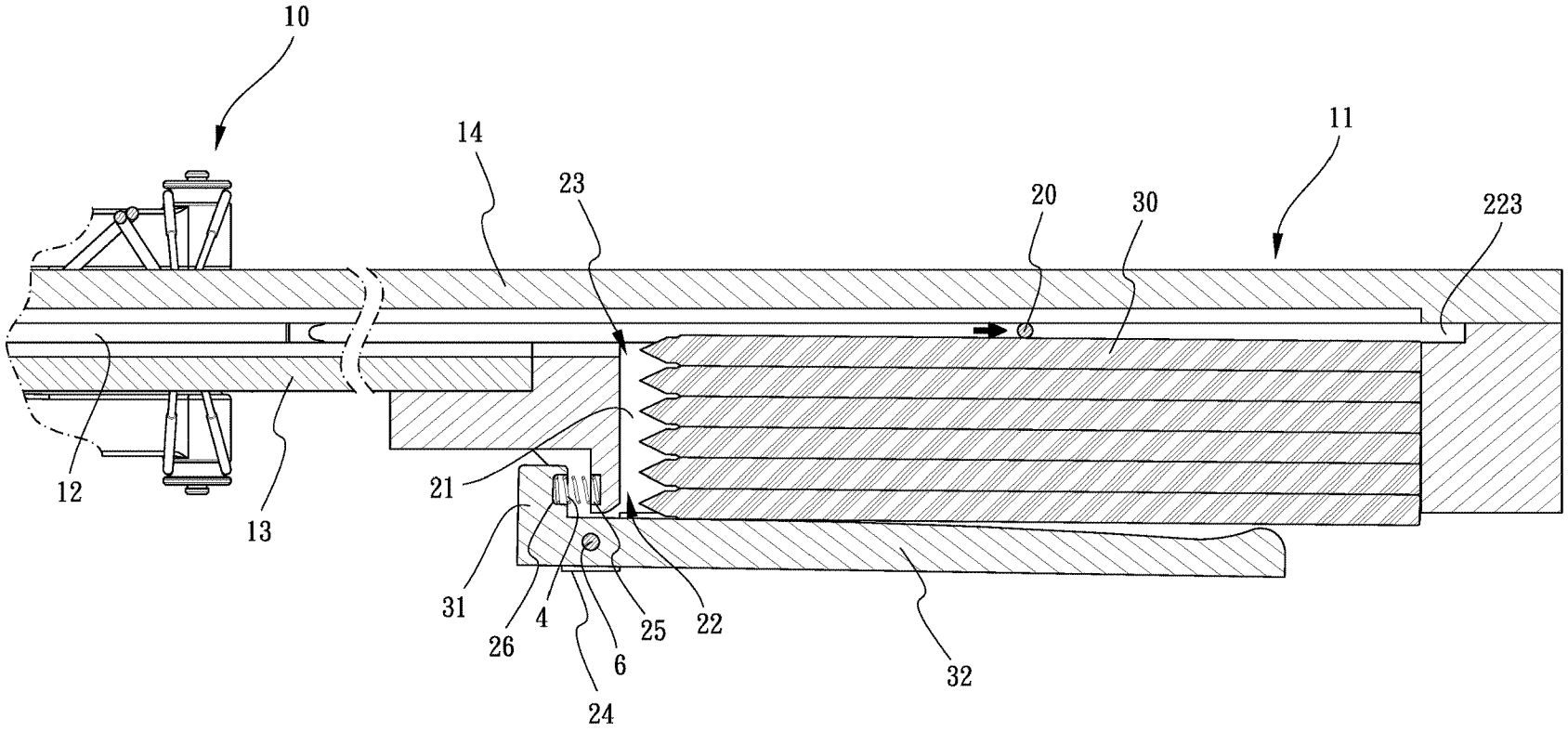
FIG. 7 shows that the string is pulled and moves over the shafts of the arrows.
Figure 8:
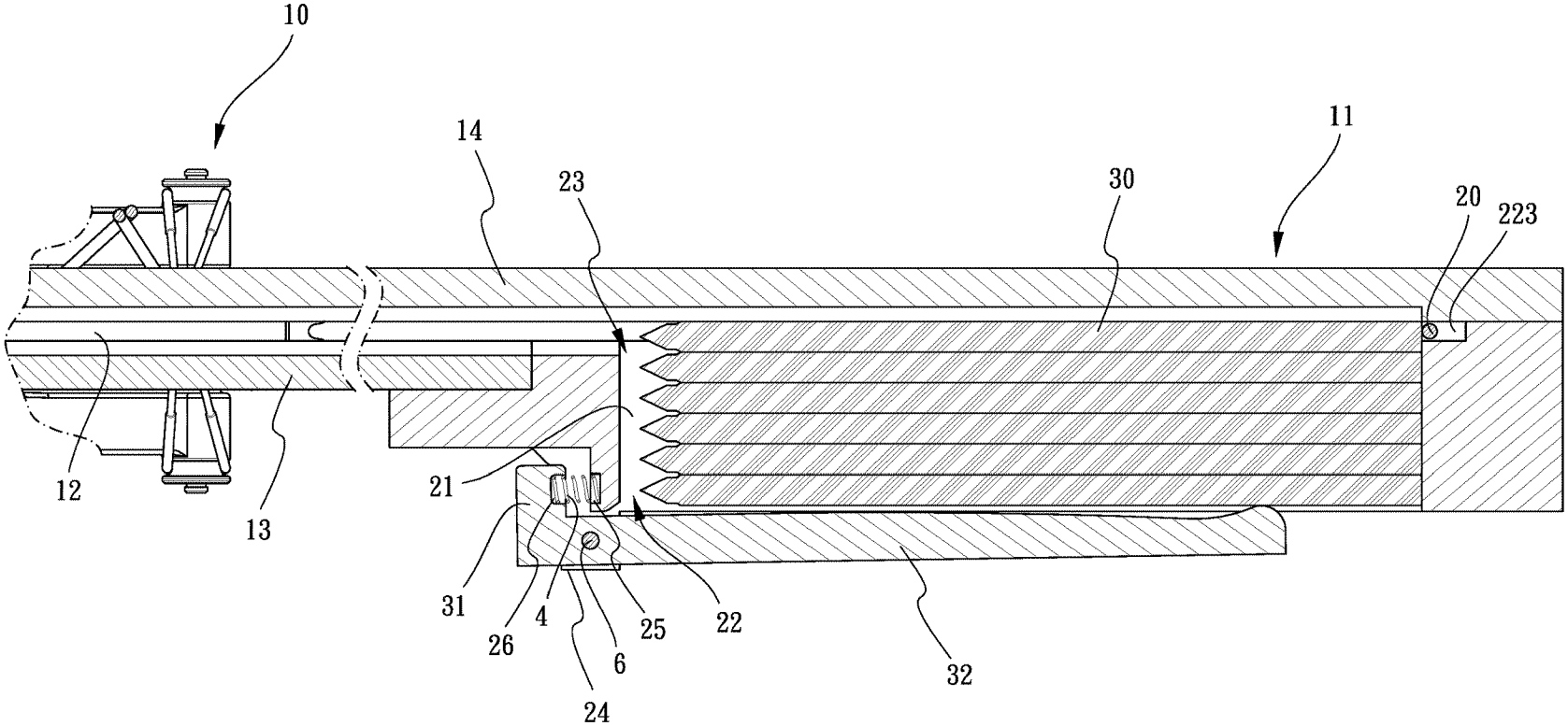
FIG. 8 shows that the string is pulled and moves over the tails of the arrows.
Figure 9:
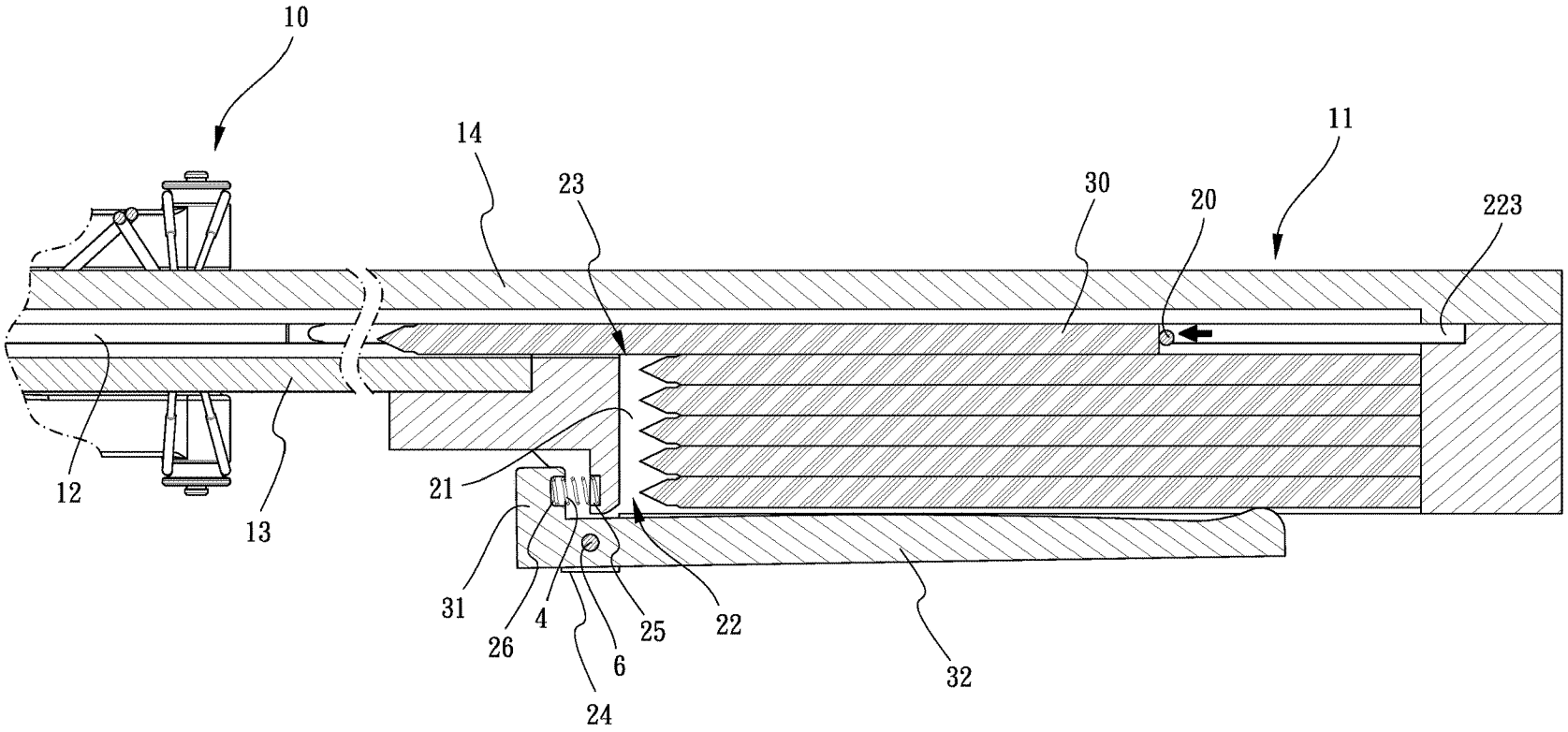
FIG. 9 shows that the string delivers one of the arrows.

As shown in FIGS. 3 and 4, the insertion path 22 includes a narrow area 221 and a wide area 222 which communicates with the narrow area 221. The size of the narrow area 221 is designed for the shaft 301 of the arrow 30, and the wide area 222 is designed for the tail 302 of the arrow 30. When inserting the arrows 30 into the cartridge 2, the front end of the shaft 301 of the arrow 30 is inserted into the insertion path 22 and moved toward the narrow area 221 and then pressed into the second passage 21. Alternatively, the tail 302 of the arrow 30 is inserted into the wide area 222 and pressed into the second passage 21. The arrows 30 are stacked in the second passage 21 and biased by the arm 32 of the press member 3 as shown in FIG. 5. The top most arrow 30 will be located in the first passage 12 of the operation box 1.

The second passage 21 includes a notch 223 defined in the inside thereof, and the notch 223 is located corresponding to the first passage 12 as shown in FIG. 5. When operating the bow, as shown in FIGS. 5 to 9, the string 20 is pulled along the first passage 12 and a portion of the string 20 moves over the shaft 301 and the tail 302 and then is accommodated in the notch 223. When the user releases the string 20, the portion of the string 20 accommodated in the notch 223 resiliently pushes and delivers the top most arrow 30 out. After the top most arrow 30 is delivered out, the press member 3 pushes the stack of the arrows 30 upward so that the top most arrow 30 is pushed into the first passage 12. The user simply pulls the string 20 again to shoot another arrow 30 without lowering the bow and picking up another arrow. That is to say, the bow still aims at the target.

Figure 10:
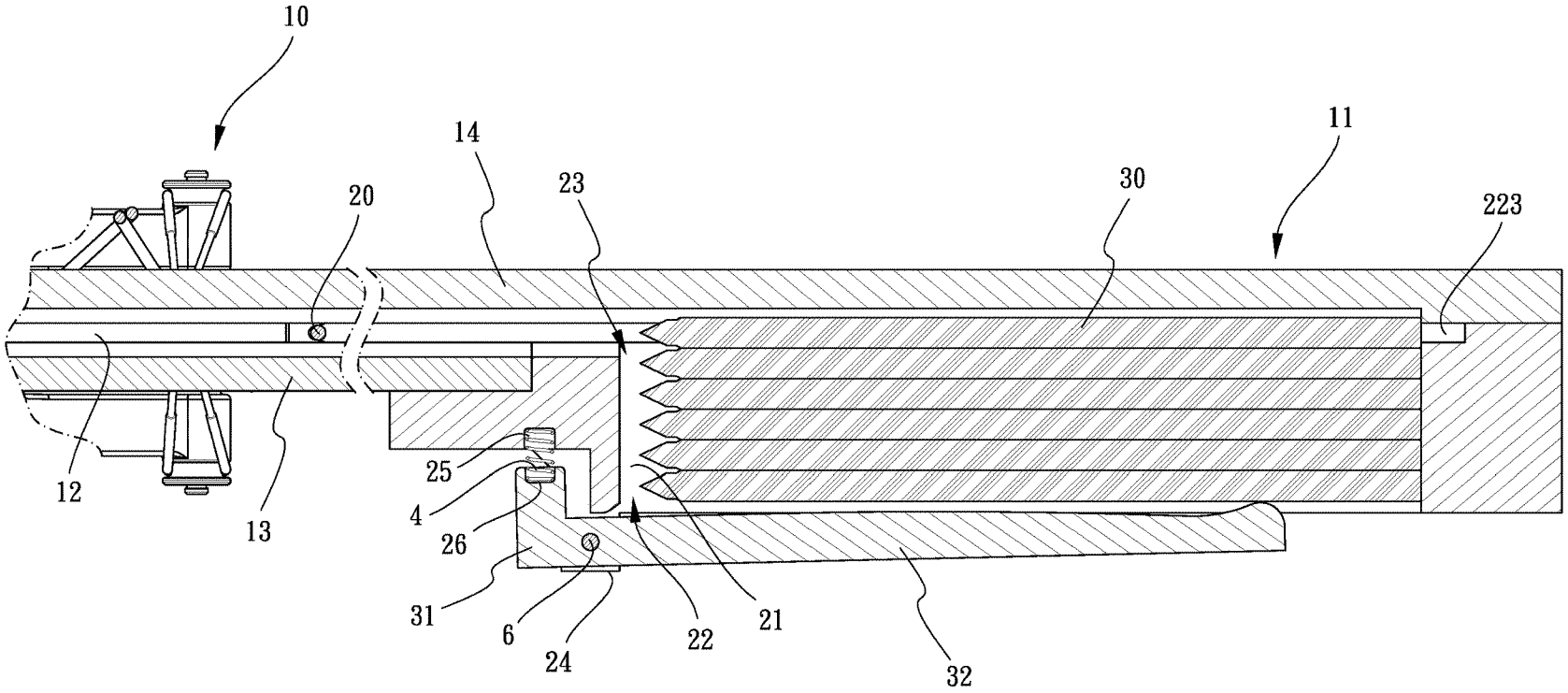
FIG. 10 shows another embodiment of the arrangement of the resilient member of the arrow supply assembly of the present invention.

FIG. 10 show another embodiment of the arrangement of the resilient member 4, wherein the resilient member 4 extends the same direction as the pivotal portion 31. The resilient member 4 is connected between the pivotal portion 31 and the cartridge 2.

Figure 11:
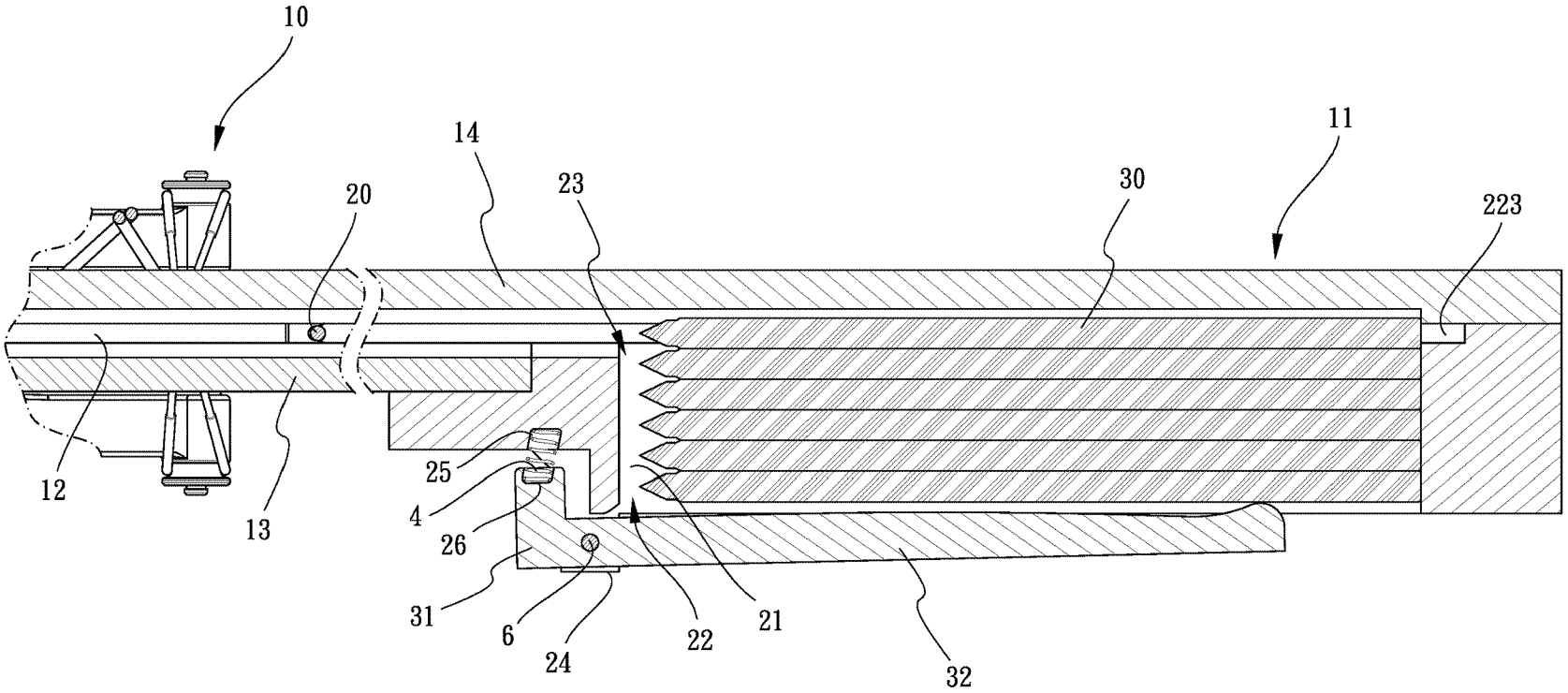
FIG. 11 shows yet another embodiment of the arrangement of the resilient member of the arrow supply assembly of the present invention.

FIG. 11 show yet another embodiment of the arrangement of the resilient member 4, wherein the first recess 25 and the second recess 26 share a common axis which extends an angle relative to the axis of the cartridge 2. The resilient member 4 is connected between the pivotal portion 31 and the cartridge 2.

While we have shown and described the embodiment in accordance with the present invention, it should be clear to those skilled in the art that further embodiments may be made without departing from the scope of the present invention.

What is claimed is:

1. An arrow supply assembly for a bow, comprising:

an operation box having a first end connected to a riser of a bow, a connection portion formed to a second end of the operation box, the operation box including a first passage defined axially through two sides thereof, a string of the bow movably extending through the first passage;

a cartridge connected to the connection portion and including a second passage which communicates with the first passage, the second passage including an insertion path and an entrance, the insertion path adapted to accept multiple arrows to be stored in the cartridge, and a press member having a first end pivotably connected to the cartridge, a resilient member connected between the press member and the cartridge so as to bias the first end of the press member, a second end of the press member inserted into the insertion path and adapted to press and supply the arrows in the cartridge into the first passage via the entrance.

2. The arrow supply assembly as claimed in claim 1, wherein the operation box includes a first plate, a second plate and two third plates, the two third plates connected between the first and second plates, the first plate is shorter than the second plate, the second plate has a first end thereof connected to the riser, a first end of the first plate is located at a distance from the first end of the second plate, the first passage is defined between the first plate, the second plate and the two third plates.

3. The arrow supply assembly as claimed in claim 2, wherein the cartridge includes a first end and a second end, two lugs extend from the first end of the cartridge and the first end of the cartridge is located close to the riser than the second end of the cartridge, the first end of the press member is pivotably connected between the two lugs by extending a pin, the cartridge includes a first recess that is located corresponding to a first end of the resilient member, the press member includes a second recess that is located corresponding to a second end of the resilient member, the first and second ends of the resilient member are secured in the first and second recesses.

4. The arrow supply assembly as claimed in claim 3, wherein the press member includes a pivotal portion and an arm which extends perpendicular to the pivotal portion, the second recess is defined in the pivotal portion, the arm is inserted into the insertion path and includes at least one point to be adapted to press the arrows.

5. The arrow supply assembly as claimed in claim 4, wherein the resilient member extends the same direction as the arm, the resilient member is connected between the pivotal portion and the cartridge.

6. The arrow supply assembly as claimed in claim 4, wherein the resilient member extends the same direction as the pivotal portion, the resilient member is connected between the pivotal portion and the cartridge.

7. The arrow supply assembly as claimed in claim 4, wherein the first recess and the second recess share a common axis which extends an angle relative to an axis of the cartridge, the resilient member is connected between the pivotal portion and the cartridge.

8. The arrow supply assembly as claimed in claim 1, wherein the insertion path includes a narrow area and a wide area which communicates with the narrow area, wherein a front end of a shaft of the arrow is inserted into the insertion path and moved toward the narrow area and pressed into the second passage, wherein a tail of the arrow is inserted into the wide area and pressed into the second passage.

9. The arrow supply assembly as claimed in claim 8, wherein the second passage includes a notch defined in an inside thereof, the notch is located corresponding to the first passage, the string is pulled along the first passage and a portion of the string is accommodated in the notch, the portion of the string accommodated in the notch is adapted to resiliently push and deliver the arrows.

10. The arrow supply assembly as claimed in claim 9, wherein an angle less than 180 degrees is formed between the string and an outside of the operation box.

* * * * *